US005139083A

United States Patent [19]

Larinoff

[11] Patent Number: 5,139,083

[45] Date of Patent: Aug. 18, 1992

[54] AIR COOLED VACUUM STEAM CONDENSER WITH FLOW-EQUALIZED MINI-BUNDLES

[76] Inventor: Michael W. Larinoff, 370 Holly Hill Rd., Oldsmar, Fla. 34677

[21] Appl. No.: 802,608

[22] Filed: Dec. 5, 1991

Related U.S. Application Data

[63] Continuation-in-part of Ser. No. 597,485, Oct. 10, 1990.

[51] Int. Cl.[5] ..... F28B 1/06; F28B 9/10

[52] U.S. Cl. ..... 165/113; 165/114; 165/900

[58] Field of Search ..... 165/113, 114, 900

[56] References Cited

U.S. PATENT DOCUMENTS 3,976,126 8/1976 Ruff ..... 165/113

4,129,180 12/1978 Larinoff ..... 165/113

FOREIGN PATENT DOCUMENTS 1370321 10/1974 United Kingdom ..... 165/113

*Primary Examiner*—Albert W. Davis, Jr.

*Attorney, Agent, or Firm*—Dominik, Stein, Saccocio, Reese, Colitz & Van Der Wall

[57] ABSTRACT

There is disclosed a new and improved single-row, two-pass steam condensing bundle used for condensing steam in air-cooled vacuum steam condensers in power plant applications and the like. The new bundle is divided into a plurality of identically built mini-bundle sets. Each mini-bundle set has one centrally located 2nd-pass tube with symmetrically placed 1st-pass tubes positioned on either side of it. The steam leaving each 1st-pass tube is controlled by a flow equalizing device installed at the end of the tubes. The flow of the non-condensible gas mixture leaving each 2nd-pass tube is controlled by an individual orifice in the gas piping system. The larger the number of mini-bundle sets incorporated into the bundle, the greater its counterflow freeze protection feature.

16 Claims, 3 Drawing Sheets

1ST PASS
2ND PASS
1ST PASS
2ND PASS

AIR COOLED VACUUM STEAM CONDENSER WITH FLOW-EQUALIZED MINI-BUNDLES

BACKGROUND OF THE INVENTION

Related Application

This application is a continuation in-part application of copending U.S. patent application Ser. No. 07/597,485 filed Oct. 10, 1990.

FIELD OF THE INVENTION

This application relates to an air cooled vacuum steam condenser with flow-equalized mini-bundles and, more particularly, to single-row, two-pass steam condensing bundles with 1st-pass tube means symmetrically positioned on opposite sides of each 2nd-pass tube.

DESCRIPTION OF THE BACKGROUND ART

This invention concerns an improvement in the design of air-cooled steam condensing bundles used in vacuum steam condensers serving steam turbine power cycles and the like where contaminated steam is condensed inside these bundles that are of single-row two-pass construction. Two-pass steam condensers have some desirable freeze abatement features but they also inherently introduce some unbalanced flow-distribution problems amongst the typical 1st-pass tubes and bundles because of lengthy steam flow distances and fan air-flow velocity profile distortions across the face of the bundles. The 1st pass tubes and bundles located furthest from the 2nd-pass tubes and bundles do not flow their design intended share of steam/gas mixture so that they become vulnerable to freezing. In addition, the dephlegmators are built as separate bundles or fan cells that are operated with cold ambient air. This invention addresses this problem by dividing the conventional size bundle into small mini-bundle groups of identically constructed sets. These sets feature one centrally located 2nd-pass tube with symmetrically placed 1st-pass tubes positioned on either side and with a new steam equalizing baffle installed at the ends of the 1st-pass tubes. The bundle thermal performance characteristics are established in part by the number of 2nd-pass tube sets that are incorporated into the bundle. The more mini-bundles and 2nd-pass tubes installed in a bundle, the greater the 1st-pass freeze protection in a suddenly dropping steam-load situation.

The background art of air-cooled steam condensers features many different bundle designs. They generally vary from 1 to 4 tube rows and are of 1, 2 or 3 pass design. Some steam condensers presently on the market do have 1st-pass main steam condensing tubes and 2nd-pass after-condenser tubes. They are sometimes called Condenser/Dephlegmator bundles that are installed in separate fan cells. They also are labeled as First Stage/-Second Stage bundles that are installed in the same fan cell. Another type has its Primary Zone/Secondary Zone steam condenser sections built into the same bundle.

None of the prior art one-row two-pass bundles address the problem of uneven steam mixture flows from 1st-pass tubes nor do they feature the grouping of 1st-pass tubes around singular 2nd-pass tubes nor do they have a flow equalizing device installed at the end of the 1st-pass tubes as revealed in this invention. Their 1st-pass tubes flow unequal quantities of steam into the 2nd-pass tubes due to differences in fan air-flow profile distortions and differences in their physical locations with the result that those 1st-pass tubes providing the least mixture are the ones that are the most subject to freezing.

The more common and obvious patents in this field are listed below along with a brief comment on their basic fluid flow design features.

1. Howard, U.S. Pat. No. 2,217,410 has a four-row two-pass design with no grouping of 1st-pass tubes around singular 2nd-pass tubes in the same bundle nor fluid control leaving the 1st-pass tubes.

2. Howard, U.S. Pat. No. 2,247,056 has a four-row two-pass design with no grouping of 1st-pass tubes around singular 2nd-pass tubes in the same bundle nor fluid control leaving the 1st-pass tubes.

3. McElgn, U.S. Pat. No. 2,816,738 has a four-row two-pass construction with no grouping of 1st-pass tubes around singular 2nd-pass tubes in the same bundle nor fluid flow control leaving the 1st-pass tubes.

4. Neimann, U.S. Pat. No. 3,289,742 has a four-row single-pass condenser with a separate 2nd-pass bundle called a dephlegmator with no grouping of 1st-pass tubes around singular 2nd-pass tubes in the same bundle nor fluid flow control leaving the 1st-pass tubes.

5. Gunter, U.S. Pat. No. 3,543,843 has a four-row single-pass design and a four-row two-pass design where the 2nd-pass is a separate bundle. There is no grouping of 1pass tubes around singular 2nd-pass tubes in the same bundle nor fluid flow control leaving the 1st-pass tubes.

6. Dehne, U.S. Pat. No. 3,556,204 has a four-row two-pass condenser with no grouping of 1st-pass tubes around singular 2nd-pass tubes in the same bundle nor fluid flow control leaving the 1st-pass tubes.

7. Staub, U.S. Pat. No. 3,677,338 has a four-row single-pass condenser.

8. Schoonman, U.S. Pat. No. 3,705,621 has a four-row two-pass design with no grouping of 1st-pass tubes around singular 2nd-pass tubes in the same bundle nor fluid control leaving the 1st-pass tubes.

9. Modine, U.S. Pat. No. 3,707,185 has a three-row single-pass condenser.

10. Schoonman, U.S. Pat. No. 3,887,002 has a four-row two-pass design for the main section and a similar construction but smaller after-condenser section. There is no grouping of 1st-pass tubes around singular 2nd-pass tubes in the bundle nor fluid flow control leaving the 1st-pass tubes.

11. Russ, U.S. Pat. No. 3,976,126 has a single-row single-pass tube condenser flowing into a separate single-row single-pass dephlegmator with no grouping of 1st-pass tubes around singular 2nd-pass tubes in the same bundle nor fluid flow control leaving the 1st-pass tubes.

12. Larinoff, U.S. Pat. No. 4,129,180 has a four-row single-pass design constituting the "main portion" and a built-in "vent condenser portion" with no grouping of 1st-pass tubes around singular 2nd-pass tubes in the same bundle for fluid flow control leaving the 1st-pass tubes.

13. Kluppel, U.S. Pat. No. 4,168,742 has a single-row single-pass design with some of the tubes divided into two channels in which the second channel is the 2nd-pass used for the removal of noncondensible gases from the outlet header. There is no grouping of 1st-pass tubes around singular 2nd-pass tubes in the same bundle nor fluid flow control leaving the 1st-pass tubes.

14. Gatti, U.S. Pat. No. 3,177,859 has a four-row two-pass design with the first three rows constituting the first condensation zone and the fourth and last row being the second condensation zone. There is no grouping of 1st-pass tubes around singular 2nd-pass tubes in the same bundle nor fluid flow control leaving the 1st-pass tubes.

15. Gerz, U.S. Pat. No. 4,190,102 has a three-row single-pass condenser and a separate three-row single-pass Dephlegmator design with no grouping of 1st-pass tubes around singular 2-nd-pass tubes in the same bundle nor fluid control leaving the 1st-pass tubes.

16. Berg, U.S. Pat. No. 4,202,405 has a four-row two-pass design with no grouping of 1st-pass tubes around singular 2nd-pass tubes in the same bundle nor fluid flow control leaving the 1st-pass tubes.

17. Zanobini, U.K. Patent No. 2,093,176 has a three-pass bundle with three-rows with no grouping of 1st-pass tubes around singular 2nd-pass tubes in the same bundle nor fluid flow control leaving the 1st-pass tubes.

18. Minami, U.S. Pat. No. 4,417,619 has a four-row bundle of two-pass design with no grouping of 1st-pass tubes around singular 2nd-pass tubes in the same bundle nor fluid flow control leaving the 1st-pass tubes.

19. Henry, U.K. Patent No. 2,137,330 has fluid flow restrictors at the end of the 1st-pass but has no 2nd-pass in his bundle.

20. Larinoff, U.S. Pat. No. 4,903,491 has a four-row single-pass condenser design.

21. Larinoff, U.S. Pat. No. 4,905,474 has a four-row single-pass condenser design.

22. Larinoff, U.S. Pat. No. 4,926,931 has a four-row two-pass condenser design with no grouping of 1st-pass tubes around singular 2nd-pass tubes in the same bundle nor fluid flow control leaving the 1st-pass tubes.

At first glance the Kluppel single-row design condenser U.S. Pat. No. 4,168,742 appears to have some similarities to this invention but on detailed examination they have little in common. Kluppel's object is the design of a single-row steam condensing bundle employing new extended surface tubes and the removal of noncondensible gasses from the outlet header by means of a venting channel that also functions as a vent condenser. Larinoff's object is to minimize the adverse effects of fan airflow velocity profile distortions across the face of the bundles and to equalize steam flows from all the st-pass tubes of a single-row steam condensing bundle by decreasing the flow travel distances between the 1and 2nd-passes and throttling the steam mixture discharges from the 1st-pass by means of a new baffle plate Kluppel's design is a "single pass arrangement" (Col. 1, line 14) with a "relatively small number of divided tubes" (Col 5, line 4) venting the outlet header. Larinoff's design is a two-pass arrangement with possibly as many as half of the bundle tubes operating in the 2nd-pass in a Condenser/Dephlegmator mode. Kluppel employs two different types and sizes of tubes for the 1and 2nd-pass (Col 4, line 15) as shown in FIGS. 6 and 7. Larinoff has only one size of tube that is used in both the 1st-pass and 2nd-pass. Kluppel does not group the 1st-pass tubes (18 and 24) symmetrically on either side of the 2nd-pass channel (23) as evidenced in FIG. 5 where the two 2nd-pass tubes (19/23) are positioned against the ends of the header (14). Larinoff groups all of his 1st-pass tubes on either side of his 2nd-pass tubes. Kluppel's 2nd-pass tube (23) is not geometrically centered (FIG. 5) amongst the 1st-pass tubes to attempt to balance the fluid forces that flow the steam/gases from the 1st-pass tubes (18) into the 2nd-pass tubes (23). Larinoff geometrically centers his 2nd-pass tubes and in addition equalizes the fluid forces from each tube by the use of flow equalizing baffle. Kluppel's 2nd-pass tube (23) section is purposely located in the upper heated portion of the tube (19) above the 1st-pass to heat its vapor contents (Col 4, line 53) whereas Larinoff's 2nd-pass tubes are the same as the 1st-pass tubes which are exposed to the ambient air. In reality, Kluppel's steam condensing tubes (18) that are adjacent to the 2nd-pass channel(23) are the ones that supply most of the steam mixture entering the 2nd-pass channel (23). The rest of the tubes suffer with stagnant gas pockets. In addition to its poor steam mixture flow to the 2nd-pass channel, the design is fundamentally flawed in its fluid flow. Kluppel connects a large cross-section tube FIG. 7 to a smaller cross-section tube shown in the lower portion of FIG. 6. Each of these tubes condenses different qualities of steam hence have different steam pressure drops. The net result is that in operation the steam either flows out of the lower portion of the tube (19) into the upper portion (23), which upsets the bundle gas removal process, or forms a stagnant pocket of noncondensible gases at the lower end of the FIG. 6 tubes. In either case it is a flawed design; fluid dynamics teaches never to connect two different diameter steam condensing tubes to the same inlet and outlet headers because they have different steam pressure drops. This causes steam to flow between tube ends in the outlet header and that is one of the major reasons for gas pockets and tube freezing.

In the review of the prior art of two-pass steam condensers there is an important design and operating feature that requires explanation. This is the feature that concerns the size of the steam condensing capability of the 2nd-pass. Some designs merely employe one or several 2nd-pass tubes in their bundle such as Larinoff U.S. Pat. No. 4,129,180 and Kluppel U.S. Pat. No. 4,168,742 that amount to about 2% to 4% of the total steam condensing capacity of the bundle. Other designs use an entire row of 2nd-pass tubes such as Gatti U.S. Pat. No. 4,177,859 which amount to 25% of the tubes but only about 10% of the total steam condensing capacity. Ruff U.S. Pat. No. 3,976,126 uses separate fan cells for the 2nd-pass bundles and they have been known to use as much as 33% of their total tubes and steam condensing capacity in 2nd-pass service.

This wide difference in the steam condensing capacity of the 2nd-pass section ranging from 2% to 33% reflects the differences in industry practice. Some manufacturers assign a purely gas vent-condenser role to the 2nd-pass tubes and they represent the 2% figure. Others assign a much broader role to the 2nd-pass tubes that involves not only the gas gathering chore but also a freeze protection contribution and they represent the 33% figure. The 2% 2nd-pass designs are generally referred to as vent-tubes while the 33% 2nd-pass designs are called Dephlegmators and secondary condensers.

The gas gathering and concentrating chore of the 2nd-pass vent tube and Dephlegmator is readily understood. The freeze protection contribution of the 2nd-pass tubes in Dephlegmators and secondary condensers requires some explanation. The Dephlegmators in A-frame condensers have their 2nd-pass tubes oriented such that the steam flows up into the tube while the condensate flows down counterflow through the steam. The thought behind this being that as long as there is steam in the 2nd-pass tubes, the condensate flowing downward through the steam cannot freeze. This design feature comes into play when there is a sudden drop in turbine exhaust steam load in freezing weather with the fans still delivering their original air quantity. This could present a dangerous freeze situation to the 2% 2nd-pass designs but not necessarily to the 33% 2nd-pass designs. The steam supply can drop 33% in this condenser which will rob all the steam in the 2nd-pass but will not jeopardize the integrity of the more vulnerable 1st-pass tubes. Incorporating such a large quantity of 2nd-pass tubes into the condenser is a form of operating insurance against certain types of potentially freezing situations. By contrast, the lower cost bundle built with vent tubes that have only 2 to 4% 2nd-pass tubes can only sustain a 2 to 4% drop in steam load before the 1st-pass tubes are exposed. This small steam capacity of the 2nd-pass section has a negligible influence on freeze protection with dropping steam loads.

Since industry practice is to condense from 2% to 33% or more of the 2nd-pass steam, the bundle of this invention must accommodate this wide range of needs. It is designed to accommodate from one 2nd-pass tube per bundle to fifty percent of the total bundle tubes in 2nd-pass mode.

SUMMARY OF THE INVENTION

The object of this invention is to improve the freeze protection of individual steam condensing tubes in single-row two-pass bundles at the lowest possible cost and complication by design improvements. This involves fluid flow improvements from the tubes into the middle and rear headers and the strategic placement and thermal shielding of the 2nd-pass tubes which are the most susceptible to freezing. As regards the fluid flow improvements, the object is to minimize the adverse effects of fan air-flow velocity profile distortions across the face of the bundles and to have the tubes that are located further away from the central flow-points pass the same mixture flow rates as the tubs that are adjacent to them. The central flow points in the middle header are the 2nd-pass tubes and in the case of the rear header it is the 1st-stage ejector. The tubes that are the farthest from the flow-points are generally the first to freeze because of their stagnation and concentration of noncondensible gases.

The 2nd-pass tubes of this invention do not require nor do they have thermal shielding in normal operation. They are exposed to the same cold ambient cooling air as the 1st-pass tubes. However, at low steam loads the 2nd-pass tube may not have any steam to condense yet they are required to function as a conduit for the noncondensible gases. Under these no-steam conditions and freezing ambient temperatures, the conduit gets cold and the water vapor in the gas mixture condenses on the inside tube surfaces forming a hoarfrost ice coating. This coating grows in thickness with time and can completely fill the 2nd-pass conduit blocking the flow of the noncondensible gases to the rear header. Present day operating practice removes this hoarfrost by stopping the motor-driven fans causing the dephlegmator/2nd-pass tubes to flood with steam and melt the hoarfrost ice. This operating practice of starting and stopping fan motors every 15–20 minutes to melt the hoarfrost is costly because it decreases the life expectancy of the electrical switchgear, motors and gear boxes. In addition, it is an operating nuisance and potential freeze hazard. In this invention the dephlegmators are not separate bundles or separate fan cells but separate 2nd-pass tubes inside the bundle surrounded by hot 1st-pass tubes. When the 2nd-pass tubes have no steam to heat the cold flowing ambient air, the turbulent warm air streams from the adjacent 1st-pass tubes intermingle with the adjoining cold air streams flowing past the 2nd-pass extended-surface fans. This mixture of air results in a heat transfer from the two adjacent hot 1st-pass oblong tubes to the upper regions of the cold 2nd-pass oblong tube. Hoarfrost will form in the cold bottom of the 2nd-pass tube but is will not close the passage gap in the warmed upper portion of the tube through which the noncondensible gases continue to flow. With such strategic placement and heating of the 2nd-pass tubes, there is no need to operate the fan motors intermittently to allow the dephlegmator/2nd-pass tubes to function at low steam-load conditions. Once the steam load increases again, it flows into the 2nd-pass tube, melts the hoarfrost ice on the bottom and returns the tubes to normal operation.

The intended steam flow patterns inside a header as visualized by the condenser designer and the actual flow patterns as achieved in practice are frequently totally different. There are three typical examples of this form of problem. The first concerns the conventional two-pass condensers where the 1st-pass section is connected to the 2nd-pass section by means of lengthy pipe and manifold. Most of the steam mixture transfer comes from the 1st-pass bundles closest to the 2nd-pass bundles. As a result of this the 1st-pass bundles farthest away contribute less of their mixture to the 2nd-pass section. Another example of such maldistribution is the case where say 50 tubes are equally spaced and attached to a header which is 10 ft wide. Now install a suction device with a one-inch pipe inlet at the center of the header. Ideally each of the 50 tubes are expected to flow 1/50th of the total suction flow. Practically, most of the fluid flow will come from the tubes located nearby in the middle of the bundle while those tubes which are 5 ft away at the ends of the header are stagnant. If the fluid is mostly noncondensible gases then the end tubes are subject to freezing. The sought design objective is to get all 50 tubes to flow a nearly equal amounts of steam/gas mixture, but this does not happen in practice. The nearby tubes flowing the most fluid are in reality flowing steam into the suction device as it cannot distinguish between the stem and the noncondensible gases. It is merely pumping whatever fluid is present nearby.

The third example of fluid flow disappointments concerns the fan air-flow velocity profile distortions that occur across the face of the bundles. The velocity profile of the air exiting the bundles is shaped like an inverted "U". It is highest in the center of the fan cell and lowest along the two ends. The tubes in the center of the fan cell condense the most steam and have the lowest steam pressure at the exit of the 1st-pass tubes. The tubes at the extreme ends condense smaller quantities of steam and have the highest steam pressures at the exit of their 1st-pass tubes. The net result is that steam in the lower headers flows toward the center tubes where they risk forming stagnant gas pockets inside the tubes.

This invention achieves its principal objectives by dividing an air-cooled bundle that is typically 8 to 12 ft. wide into many mini-bundle sets of identical construction. The oblong heat-exchange tubes are arranged in a two-pass mode by grouping adjacent tubes into identical sets positioned side-by-side where each tube set has one centrally located and end-plugged 2nd-pass tube with a plurality of 1st-pass tubes symmetrically placed on either side of it. The steam that enters one end of the 1st-pass tubes and exits at the other end is only partially condensed. What remains then enters the adjoining 2nd-pass tube to be completely condensed with its noncondensible gases induced to flow to the closed far end of this 2nd-pass tube from whence the gases are removed by suction means.

This new bundle is installed in a typical A-frame with the steam supply header at the entrance to the 1st-pass tubes and a middle header at the end. This middle header also serves as a steam supply header to the 2nd-pass tubes. But before leaving the 1st-pass tubes and entering the middle header, the steam/gas mixture may pass through a baffle plate when required which equalizes the flow rate from all 1st-pass tubes. There also are suitable condensate draining and collecting means installed at the bottom of the bundle. The steam/gas mixture in the closed end of the 2nd-pass tubes is induced to flow through a fixed orifice into a bundle rear-header manifold that connects all the orifices of that bundle together. The exiting noncondensible gases from all the bundles of the one fan cell are connected together to a fan cell pipe manifold which terminates at the suction of a 1st-stage ejector.

Grouping the 1st-pass tubes into physically small sets that are served by one centrally located 2nd-pass tube not only provides the desired heat transfer protection to the 2nd-pass tubes under no steam-flow conditions but it also provides the shortest possible travel path to the steam exiting the 1st-pass tubs and entering the 2nd-pass tube. Short travel paths are the best means for assuring equalized flow rates from a group of tubes.

However, as the travel paths get longer there is a need for some additional assistance to balance the steam flows coming from the further tubes. This additional assistance can be some form of throttling device installed in each tube. In this invention that throttling device is a new and simple flow-equalizing baffle that is placed over the ends of the 1st-pass tubes inside the middle header. This baffle controls the team flow rates by introducing velocity change losses ($V_2^2 - V_1^2/2g$) at the end of each 1st-pass tube. The velocity $V_1$ is the low steam/gas mixture velocity at the end of the tube while $V_2$ is the high velocity of the mixture flowing through the opening of the equalizing baffle. The exiting steam velocities are made different for each tube because their velocity head losses must all be different. They must be made different because they are all located at different distances from the 2nd-pass tube opening. They all experience different frictional fluid losses and velocity change losses.

The flow equalizing baffle is a shaped metal plate that is tack-welded over the ends of the 1st-pass tubes. It is custom shaped to pass the desired steam flow-through rate of each 1st-pass tube or group of tubes. In addition to equalizing steam flows, the baffle can be shaped to compensate for the distorted cooling air velocity through the bundles along their width and length. In this case those 1st-pass tubes that receive the highest velocity cold air need protection by flowing a larger amount of steam for condensing in the 2nd-pass. Thus the steam flow in the 1st-pass tubes can be controlled by tailoring the baffle shape to resolve the problem.

Flow equalizing baffles can also be used in condenser designs that employ separate bundles in the same fan cell or separate fan cells for their 2nd-pass after-condenser tubes. They can be used wherever there is need to equalize the flow by controlling the fluid rate leaving one set of tubes or bundles and entering another. For best performance they should be installed on the discharge side of the 1st-pass tubes.

Nothing has been done in the past to correct this maldistribution flow problem because of the difficulty in installing baffles in front of a multitude of small tubes. Now that the newly developed, large, single-row-, rectangular/oval shaped steam condensing tube with extended air-cooled surfaces are both popular and economic, the solution to the problem is much easier. Where earlier the condenser designer was dealing with four rows of one-inch diameter tubes, the new single rectangular tube replacing them is about one inch wide by 7-9 inches high. This increase in tube depth by 7 to 9 times allows the use of a simple and inexpensive flow-equalizing baffle installed over a group of designated tubes at the exit of the 1st-pass.

The bundle overall thermal performance characteristics and the uncondensed steam flow rates in the 1st-pass tubes are established by the number of 2nd-pass tube sets that are incorporated into the bundle which can vary from one tube to half of the installed tubes. Depending on the plant needs and climatic conditions, the condenser designer has the option of installing only a small 2nd-pass gas concentrator or a large size Dephlegmator/secondary condenser. The advantages of the larger and more costly Dephlegmator/secondary condenser are primarily in freeze protection as was discussed earlier. The more mini-bundles and 2nd-pass tubes installed in a bundle, the greater the 1st-pass freeze protection in a suddenly dropping steam-load situation.

The number of 2nd-pass tubes installed in a bundle determines whether a steam-flow equalizing plate is to be used or not. In the case where there is only one, two, four, etc. 1st-pass tubes per one 2nd-pass tube, there is no need or little need for the baffle. As the number of 1st-pass tubes served by one 2nd-pass tube increases, the need for the baffle becomes more urgent to balance out the steam flows.

The steam condensing unit that is made up of a multitude of fan cells need not all have the same number of 2nd-pass tubes in each fan cell. For example, those fan cells operating alone during the cold winter may have mini-bundles built with two 1st-pass tubes per one 2nd-pass tube while the remaining cells operating only during the warm weather may have one or two 2nd-pass tubes serving the entire bundle of 1st-pass tubes.

The concept of mini-bundles and flow equalizing baffles installed in a single-row two-pass bundles can be used in the two basic A-frame configurations. One configuration has the steam supply duct located at the apex of the A-frame with the steam and condensate flowing in the same direction in the 1st-pass. The second orientation has the steam supply duct located at the base of the A-frame with the steam flowing up and the condensate flowing down in counterflow manner in the 1st-pass. This new bundle design concept is adaptable to both configurations.

As there is need to equalize the flow of steam and inert gases going from the 1st-pass tubes into the 2nd-pass tubes, there is also the urgent need to equalize the noncondensible gas withdrawal rate from the ends of each of the 2nd-pass tubes. The gases leaving each 2nd-pass tube flow through an individual fixed orifice whose diameter depends on the location of the 2nd-pass tube in relation to the center of the bundle and the bundle location in reference to the 1st-stage ejector. The fixed orifice is a drilled hole located in the tube closure plate, at the top of the heat exchanger tube or in the bundle manifold pipe. The farther the 2nd-pass tube is from the center of the bundle where the manifold pipe tee is located, the larger the hole. Also, the further the bundles are from the suction of the 1st-stage ejector, the larger the orifices. This balanced flow gas withdrawal concept is based on the suction sparger device patented by Larinoff in U.S. Pat. Nos. 4,903,491 and 4,905,474 and 4,926,931.

As there is need to equalize the flow of steam/gas mixtures amongst the tubes there is also a need to isolate the noncondensible gas system of each fan cell, one from the other. This is the subject of a Larinoff U.S. patent application Ser. No. 07/597,485 fled Oct. 10, 1990, the subject matter of which is incorporated by reference herein. The bundles are installed in an A-frame configuration and served by a single fan with the noncondensible gas withdrawal from each bundle connected to one 1st-stage ejector that serves only the bundles of that one fan cell. Fan cell isolation lessens the freeze problem and allows greater flexibility in fan control. Individual fan motors can be stopped and/or reversed without affecting the operation of other fan cells in the condenser.

In cold climates and strong wind locations it is very desirable to isolate and protect both sides of a fan cell from freezing. The noncondensible gas withdrawal from all the bundles on one side of the A-frame are connected to one 1st-stage ejector and the noncondensible gas withdrawal from all the bundles on the other side of the A-frame are connected to a second 1st-stage ejector, both ejectors serving only that one fan cell, with this arrangement both halves of the fan cell are isolated from each other so that strong winds blowing on one side of the A-frame will not affect the performance of the other half fan cell located on the protected side.

BRIEF DESCRIPTION OF THE DRAWINGS

For a fuller description of the nature and objects of the invention, reference should be made to the following detailed description taken in conjunction with the accompanying drawings in which.

The same reference numerals refer to similar parts throughout the various figures.

DETAILED DESCRIPTION OF THE INVENTION

Overview

This invention relates to air-cooled vacuum steam condensers or other vapors that are contaminated with inert gases and air. More specifically, it relates to an improved bundle design that groups its 1st-pass and 2nd-pass steam tubes into identical mini-bundle sets and adds some internal baffles to further assist in the flow equalizing process.

The construction elements that constitute a complete steam condensing unit are as follows. One set of individual identical oblong tubes with extended air-cooled surfaces constitute a mini-bundle. About 2 to 25 mini-bundles make up one conventional bundle. The overall dimensions of a typical bundle are approximately 8 to 12 ft. wide by 20 to 40 ft. long regardless of the number of mini-bundle sets it may divided into. About 4 to 10 bundles make up one fan cell set in an A-frame configuration which typically has one motor driven forced draft fan 10. A multitude of identical fan cells make up the air-cooled vacuum steam condenser.

Figure 22:
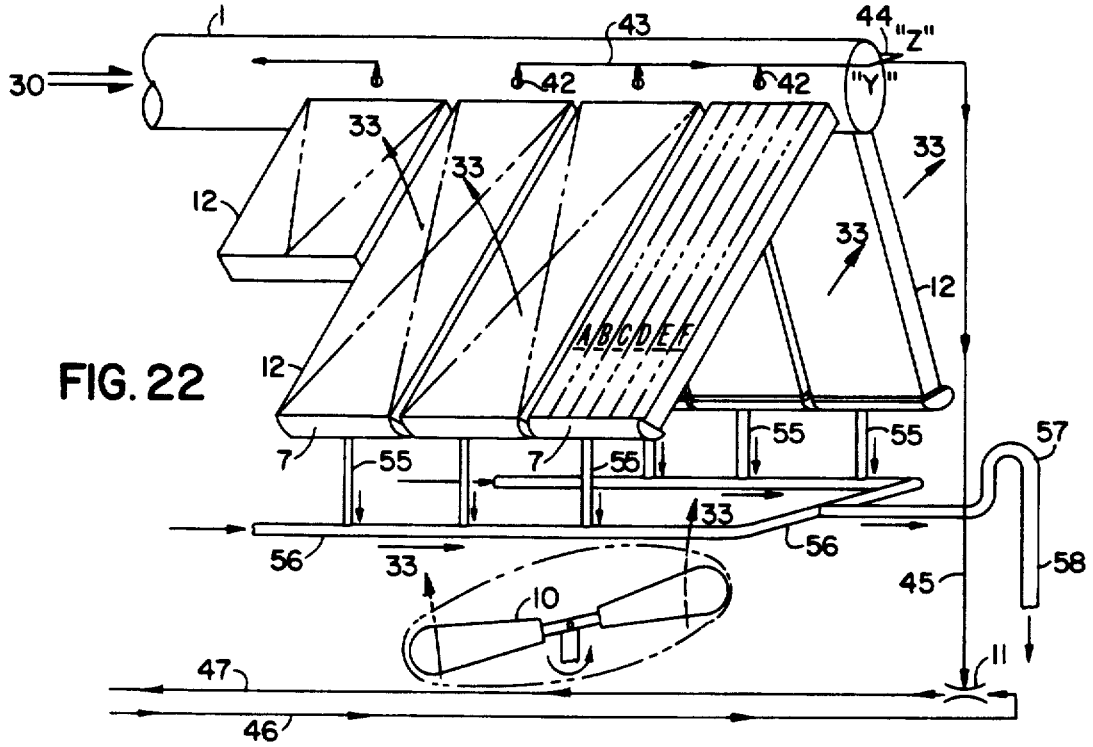
FIG. 22 is an isometric view of a typical six bundle condenser fan cell employing the bundle arrangement shown in FIGS. 13, 14, 15, 16 and 17.

One fan cell of such a typical vacuum steam condenser consisting of six bundles is shown in FIG. 22. Turbine exhaust steam flows through the steam supply header and enters the tube bundles where it is partially condensed in the 1st-pass by the ambient air 33 that is moved by a motor driven fan 10. The remaining steam leaves the 1st-pass tubes through the middle header and enters the 2nd-pass tubes where it is then completely condensed. The resulting condensate flows into the middle header where it is all collected and is then drained through water leg seals into a manifold, passes through a system water loop seal and from there it flows into the conventional condensate storage tank to be returned to the power cycle. The noncondensible gases withdrawn from the end of the 2nd-pass tube flow through a fixed orifice and then into a pipe manifold located inside the steam supply header and from there they flow through a pipe connected to a manifold that conveys them to the suction side of a 1st-stage steam jet air ejector that removes them permanently from the system. Such is the basic fluid flow operation of this air-cooled vacuum steam condenser.

Mini-Bundle Tube Sets

Figure 1:
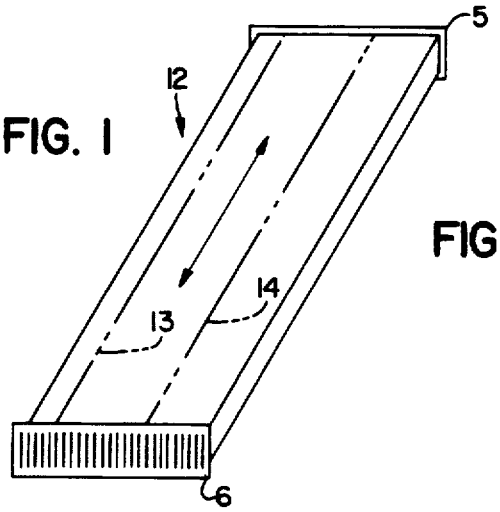
FIG. 1 is a typical air-cooled single bundle with one front header on one end and one middle header on the other end. The bundle has oblong tubes running lengthwise with extended surface cooling fins, not shown, on the outside of the tubes.

The typical single-row steam condensing air-cooled bundle is shown in FIG. 1. The extended-surface oblong air-cooled tubes 13, 14 are welded to a front header and a middle header plate 6. The tubes are typically 1 inch wide, 7-9 inches high and 20-40 ft. long. About 50-55 tubes are stacked side-by-side to make a 8-12 ft. wide bundle 12.

Figure 2:
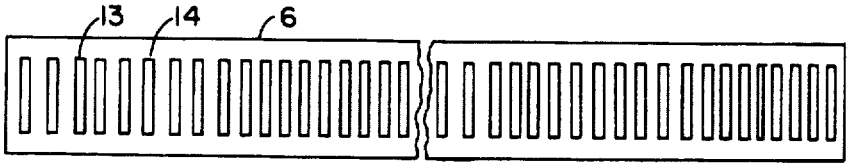
FIG. 2 is a view of the bundle header looking into the oblong tubes.
Figure 3:
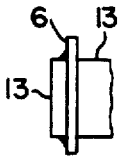
FIG. 3 is a side view of FIG. 2 showing the tubes protruding slightly beyond the header for welding purposes.

FIG. 2 is a view of one of the headers 5, 6 looking directly into the oblong tubes 13, 14. FIG. 3 is a side view of the header (6) showing the tube 13 protruding out slightly to allow a weld connection.

Figure 4:
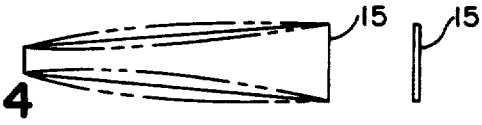
FIG. 4 is a sheet-metal flow-equalizing baffle plate.

FIG. 4 shows a sheet metal flow-equalizing baffle 15 of the type used in FIGS. 7, 8, 9 and 10 that covers the ends of the 1st-pass tubes. Various shapes of the baffle plate 15 are shown in FIG. 4. The shape can be a straight line or tailored such as concave downward or convex upward to meet the individual flow needs of the tubes being covered. This baffle is tack welded to the ends of the tubes and need not be fluid-tight around the tubes.

Figures 5, 6:
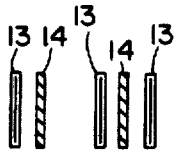
FIG. 5 is a view looking into the tubes of a mini-bundle with one 1st-pass tube and one 2nd-pass tube.
FIG. 6 is the same as FIG. 5 except it has two 1st-pass tubes.

FIG. 5 shows a two tube mini-bundle consisting of one 2nd-pass tube 14 and one 1st-pass tube 13. A bundle of this type would have 50% of its tubes in the 2nd-pass. No flow equalizing baffle 15 is required.

FIG. 6 shows a 3-tube mini-bundle consisting of one 2nd-pass tube 14 and two 1st-pass tubes 13. It may or may not require a flow equalizing baffle 15. A bundle of this type would have 20% of its tubes in the 2nd-pass.

Figure 7:
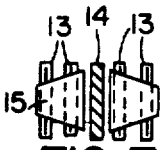
FIG. 7 is a view looking into the tubes of a mini-bundle with four 1st-pass tubes and one 2nd-pass tube with the 1st-pass tubes partially covered with a flow-equalizing baffle.

FIG. 7 shows a 5 tube mini-bundle consisting of one 2nd-pass tube 14 and six 1st-pass tubes 13. It may or may not require a flow equalizing baffle 15. A bundle of this type would have 20% of its tubes in the 2nd pass.

Figure 8:
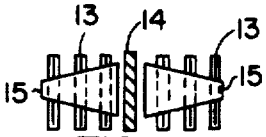
FIG. 8 is the same as FIG. 7 except it has six 1st-pass tubes.

FIG. 8 shows a 7 tube mini-bundle consisting of one 2nd-pass tube 14 and six 1st-pass tubes 13. A bundle of this type would have 14% of its tubes in the 2nd-pass.

Figure 9:
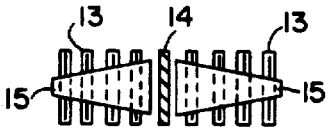
FIG. 9 is the same as FIG. 7 except it has eight 1st-pass tubes.

FIG. 9 shows a 9 tube mini-bundle consisting of one 2nd-pass tube 14 and eight 1st-pass tubes 13. A bundle of this type would have 11% of its tubes in the 2nd-pass.

Figure 10:
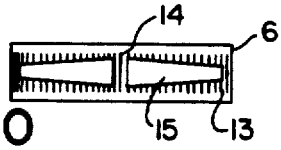
FIG. 10 is the same as FIG. 7 except it has all of the tubes in the bundle as 1st-pass tubes except one which is the 2nd-pass tube.

FIG. 10 shows a 50 tube mini-bundle consisting of one 2nd-pass tube 14 and forty-nine 1st-pass tubes 13. A bundle of this type would have 2% of its tubes in the 2nd-pass.

Figure 11:
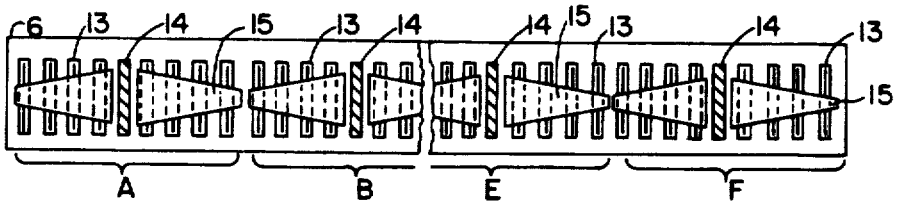
FIG. 11 is FIG. 2 covered with FIG. 9 flow-equalizing baffle plates. The cross-hatched tubes are the 2nd-pass tubes.

FIG. 11 shows what the rear of the bundle FIG. 2 would look like with FIG. 9 baffle plates 15 installed. The six mini-bundles are identified and labeled as A, B, C, D, E and F on both FIG. 11 and FIGS. 22 and 23.

Figure 12:
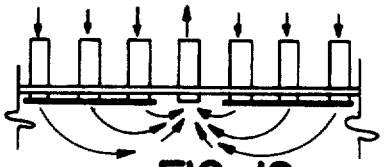
FIG. 12 is a top view of FIG. 8 showing the baffle plate in front of the tubes and with arrows showing fluid-flow directions.

FIG. 12 shows a top view of FIG. 8 with the steam flow directions indicated from 1st-pass tubes 13 into the 2nd-pass tube 14.

Fan Cell Installations

Figures 13, 14, 15, 16, 17, 18, 19, 20, 21:
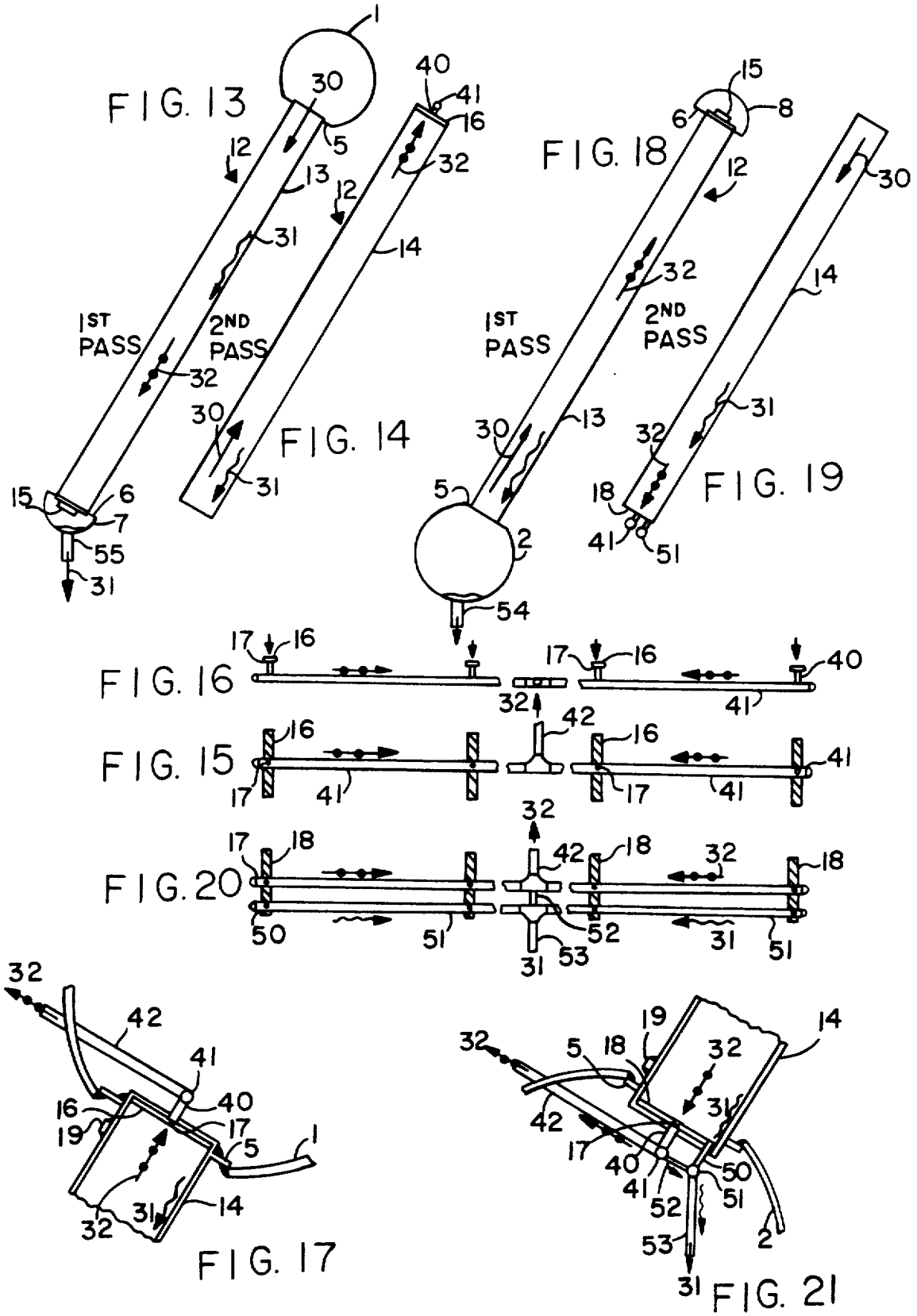
FIG. 13 is an end elevation view of one side of an A-frame condenser showing fluid-flow directions where the steam supply duct is on the top of the apex with the 1st-pass tubes flowing steam and condensate downward in parallel flow.
FIG. 14 shows the internal fluid flow of the 2nd-pass tube in FIG. 13.
FIG. 15 shows the upper cover plates for the 2nd pass tubes of FIG. 14 together with the noncondensible gas pipe manifold.
FIG. 16 is the top view of FIG. 15.
FIG. 17 is an enlarged view of the upper end of FIG. 14 with some additional detail.
FIG. 18 is an end view of one side of an A-frame condenser showing fluid flow directions where the steam supply is on the bottom of the frame with the 1pass tubes flowing the condensate downward counter to the steam flowing upward.
FIG. 19 shows the internal fluid flow of the 2nd pass tube in FIG. 18.
FIG. 20 shows the lower cover plates for the 2nd pass tubes of FIG. 19 together with the noncondensible gas pipe manifold and the condensate drain manifold.
FIG. 21 is an enlarged picture of the lower end of FIG. 19 with some additional detail.

FIGS. 13, 14, 15, 16 and 17 are the design and flow details for the six bundle fan cell shown in FIG. 22. In FIG. 13 the steam supply header 1 is welded to the front header plate 5 which is part of the bundle 12 assembly. The middle header 7 is welded to its header plate 6 at the lower end of the bundle. The steam 30 flows from the supply header 1 into the 1st-pass steam condensing tubes 13 and the resulting condensate 31 flows down into the middle header 7 and drain line/water leg seal 55. The remaining steam and noncondensible gases 32 flow through the flow equalizing baffles 15 at the end of the 1st-pass tubes 13 and enter the 2nd-pass 14, FIG. 14. Here the steam and gases flow upward into the tube 14 while the condensate 31 flows downward into the middle header 7. The noncondensible gases 32 flow upward to the end of the 2nd-pass TM tube 14, FIG. 17, and are sucked through a fixed orifice 17 into a pipe nipple 40, bundle pipe header 41, bundle pipe 42, fan cell gas manifold 43 and finally into the inlet side of a 1st-stage ejector 11. The steam pipe manifold 46 delivers the motive steam to the ejector 11 while the gas pipe manifold 47 removes the inert gas mixture and delivers it to the conventional inter-condenser/2nd-stage ejector/after-condenser set for discharge into the atmosphere.

Pipe boss 19 on the top of tube 14 shows an alternate location for the withdrawal of the inert gases. The gas manifold piping 41 would be outdoors above the bundles. The orifice 17 could be drilled and located either in the tube closure plate 16 as shown, the pipe boss 19 or the pipe manifold 41.

The inert gas manifold 44 serving the right-hand side bundles as shown in FIG. 22 can be disconnected at point "Z" from manifold 43 point "Y" and another 1st-stage ejector installed to serve those bundles. The 1st-stage ejector 11 would serve the left hand bundles while the second ejector would serve the right-hand side bundles. These two ejectors serving one fan cell would protect the fan cell from the damaging effects of strong, cold, prevailing winds.

Figure 23:
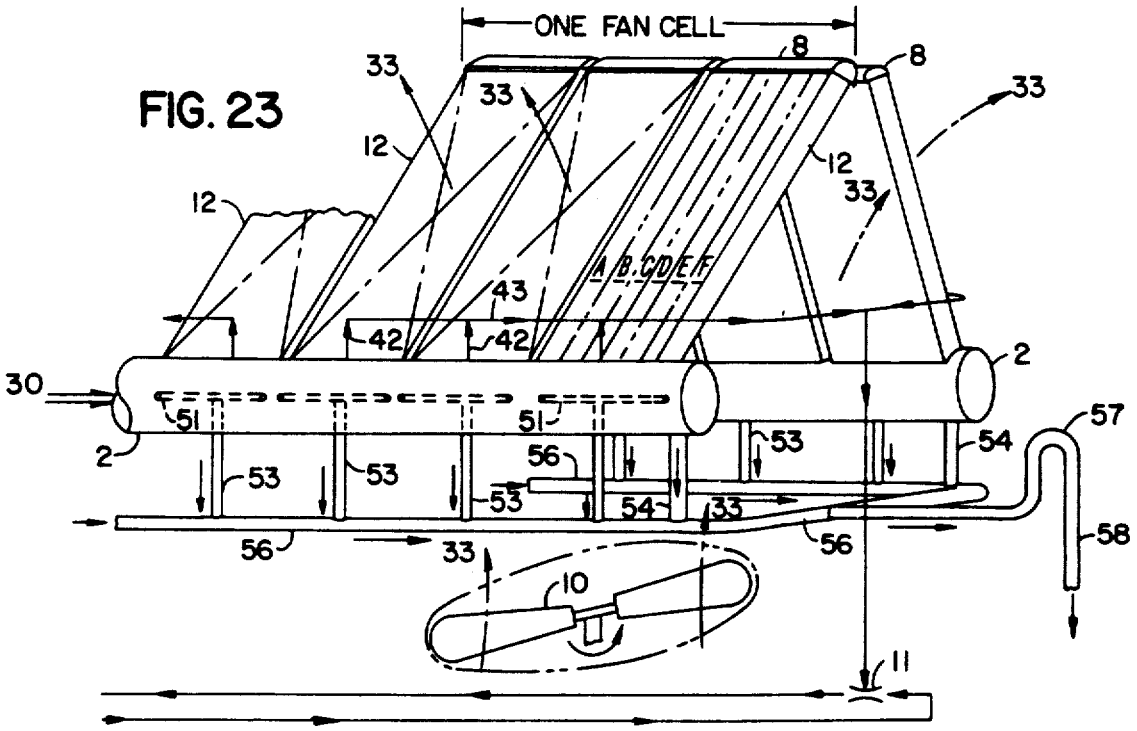
FIG. 23 is an isometric view of a typical six bundle condenser fan cell employing the bundle arrangement shown in FIGS. 18, 19, 20, 16 and 21.

FIGS. 18, 19, 20, 16 and 21 are the design and flow details for the six bundle fan cell shown in FIG. 23. In FIG. 18 the steam supply header 2 is welded to the front header plate 5 which is part of the bundle 12 assembly. The middle header 8 is welded to its header plate 6 at the upper end of the bundle. The steam 30 flows from the supply header 2 into the 1st-pass steam condensing tubes 13 and the resulting condensate 31 flows down into the steam supply header 2 and water leg seal 54. The remaining steam and noncondensible gases 32 flow through the flow equalizing baffles 15 at the end of the 1st-pass tubes 13 and enter the 2nd-pass, FIG. 19. Here the steam, condensate, and gases flow downward, FIG.

21, toward the closed end of the 2nd-pass tube 14. The tube closure plate 18 has two outlets, one for the noncondensible gases and the other for the condensate. The condensate flows through a pipe nipple 50 and enters a bundle pipe manifold 51 and from there it flows into water leg seals 53. Condensate manifold piping 56 collects and carries all of the condensate 31 through the system loop seal 57 and into the condensate storage tank via piping 58. The inert gases pass through orifice 17, FIG. 21, pipe nipple 40 then flow into pipe manifold 41. Any condensate that enters orifice 17 and manifold 41 flows into condensate manifold 51 via drain pipe 52. The noncondensible gases pass on through bundle pipe 42 and into fan cell gas manifold 43 and are finally sucked out by the 1st-stage ejector 11. All other subsequent details are the same as was discussed in connection with FIG. 22.

Figure 24:
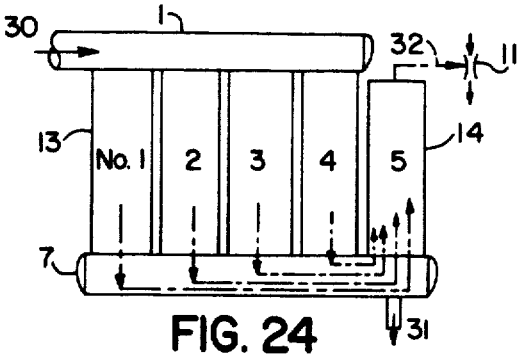
FIG. 24 PRIOR ART
FIG. 24 is a simplified layout of a prior art two-pass five bundle condenser showing the long paths inside the middle headers for the steam flow from 1st-pass bundles No. 1 and 2 flowing into the 2nd-pass bundle No. 5.

FIG. 24 shows the typical prior art two-pass Condenser/Dephlegmator arrangement in its basic form. There are a total of 5 bundles, or fan cells, where one (No. 5) is the 2nd-pass Dephlegmator unit that condenses approximately 20% of the total steam flow. Assume these are bundles and that they are 8 ft wide containing 50 tubes each. There are 200 tubes flowing a steam mixture out of the 1st-pass condenser into 50 tubes of 2nd-pass dephlegmator. The furthest flow distance is 40 ft and the shortest is less than 1 ft. If instead of bundles these are fan cells of 5 bundles each, then the furthest flow distance is 200 ft and the shortest is again less than 1 ft. The condenser designer assumes that each condenser tube is passing 20% of its steam in a flow-through manner to be condensed in the dephlegmator. What chance does the tube that is 40 to 200 ft away from the dephlegmator have of flowing its design quantity of 20% steam compared to the tube that is less than one foot away? It is this mal-distribution of flow-through steam that encourages the formation of stagnant pockets of noncondensible gases inside the bundle tubes that become frozen pockets followed by damaged tubes.

The maldistribution problem does not end there. There is this other disturbing force caused by the adverse effects of fan air-flow profile distortion across the face of the bundles. Since all the tubes in a fan cell do not experience the same air-flow velocity they condense different quantities of steam, have different pressure drops and, therefore, encourage the formation of stagnant gas pockets. The FIG. 24 design shows 4 condenser bundles extending 32 ft in width. The fan air-flow exit profile distortion would be very large over this 32 ft width.

Figure 25:
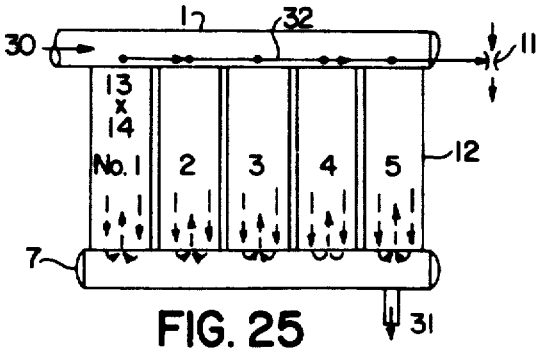
FIG. 25 is the new invention applied to a two-pass five bundle condenser showing the very short travel paths for the steam flowing from the 1st-pass into the 2nd-pass inside the middle header. This is to be compared with FIG. 24.

FIG. 25 shows the new invention Condenser/Dephlegmator arrangement with 20% of the steam condensed in the 2nd-pass dephlegmator, the same as FIG. 24. The mini-bundle tube arrangement is shown in FIG. 7. There are 5 tubes per mini-bundle and 10 mini-bundles per bundle. Each mini-bundle is about 0.8 ft or 9.6 inches wide. The longest steam travel distance from the 1st-pass tubes into the 2nd-pass tube is 4.8 inches. Compare this with the 32 ft travel distance with the FIG. 24 design. As regards air-flow distortions, the mini-bundle width is only 9.6 inches. This again is a negligible dimension for air-flow distortions to occur in compared to 32 ft. The fluid flow of FIG. 25 are obviously a superior design compared to the current FIG. 24 design.

This invention also takes advantage of the concept of Larinoff's U.S. Pat. Nos. 4,903,491 and 4,905,474 and 4,926,931 to improve the removal of the noncondensible gasses from the bundle rear headers. FIG. 24 shows the piping from the 1st-stage ejector 11 leading to one or possibly several connections to the rear header. This is a very unsatisfactory method for the removal of those gases as was explained in the aforementioned Larinoff patents. In FIG. 25 each 2nd-pass tube is connected by orifice to the 1st-stage ejector 11 for the positive and direct removal of their gases.

The mini-bundle and flow-equalization concepts outlined herein can also be applied to bundles that have two or more tube rows that are stacked one on top of the other employing either common or individual headers or some combination thereof.

The present disclosure includes that contained in the appended claims as well as that of the foregoing description. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed:

1. An improved single-row air-cooled steam condenser bundle with identical oblong heat exchange tubes arranged in a two-pass mode by grouping adjacent tubes into identical multiple sets positioned side-by-side where each tube-set has one centrally located and end-plugged 2nd-pass tube with a plurality of 1st-pass tubes symmetrically placed on either side of it with the steam entering one end of the 1st-pass tubes and exiting at the other end only partially condensed then entering the adjoining 2nd-pass tube to be completely condensed with its noncondensible gases induced to flow to the closed far-end of this 2nd-pass tube from whence the gases are removed by suction means.

2. A multiplicity of the claim 1 tube sets assembled to form a bundle installed in an A-frame with a main steam supply header at the entrance to the 1st-pass tubes, a middle header at the end of the 1st-pass tubes serving also as a steam supply header to the 2nd-pass tubes, suitable condensate draining and collecting means at the bottom of the bundle, a noncondensible gas mixture flow-control orifice located at the end of each 2nd-pass tube that is connected downstream to a bundle rear header pipe manifold that in turn is connected to a fan cell pipe manifold which terminates at the suction of a 1st-stage ejector while external fan means move the cooling media ambient-air over the extended surfaces of the oblong steam condensing tubes.

3. The bundle of claims 2 have their noncondensible gases leaving each 2nd-pass tube flow through an individual fixed orifice whose diameter depends of the location of the 2nd-pass tube in relation to the center of the bundle and the bundle location in reference to the 1st-stage ejector.

4. The bundles of claims 2 installed in an A-frame configuration and served by a single fan with the noncondensible gas withdrawal from each bundle connected to one 1st-stage ejector that serves only the bundles of that one fan cell.

5. The bundles of claim 2 installed in an A-frame configuration and served by a single fan with the noncondensible gas withdrawal from all the bundles on one side of the A-frame connected to one 1st-stage ejector and the noncondensible gas withdrawal from all the bundles on the other side of the A-frame connected to a second 1st-stage ejector, both ejectors serving only that one fan cell.

6. The bundles of claims 2 oriented such that the main steam supply header is at the apex of the A-frame with the steam flowing downward in the 1st-pass tubes.

7. The bundles of claims 2 oriented such that the main steam supply header is at the bottom of the A-frame with the steam flowing upward in the 1st-pass tubes.

8. A multiplicity of the claim 1 tube sets assembled to form a bundle installed in and A-frame with a main steam header at the entrance to the 1st-pass tubes, a steam flow-equalizing baffle at the exit of the 1st-pass tubes, a middle header at the end of the 1st-pass tubes serving also as a steam supply header to the 2nd-pass tubes, suitable condensate draining and collecting means at the bottom of the bundle, a non-condensible gas mixture flow-control orifice located at the end of each 2nd-pass tube that is connected downstream to a bundle rear header pipe manifold that in turn is connected to a fan cell pipe manifold which terminates at the suction of a 1st-stage ejector while external fan means move the cooling media ambient-air over the extended fin surfaces of the oblong steam condensing tubes.

9. The bundle of claim 8 with a steam flow-equalizing baffle plate installed at the end of the 1st-pass tubes that is custom shaped to pass the desired steam flow-through rate of each 1st-pass tube or group of tubes.

10. The bundle of claims 3 have their noncondensible gases leaving each 2nd-pass tube flow through an individual fixed orifice whose diameter depends of the location of the 2nd-pass tube in relation to the center of the bundle and the bundle location in reference to the 1st-stage ejector.

11. The bundles of claims 8 installed in an A-frame configuration and served by a single fan with the noncondensible gas withdrawal from each bundle connected to one 1st-stage ejector that serves only the bundles of that one fan cell.

12. The bundles of claims 8 installed in an A-frame configuration and served by a single fan with the noncondensible gas withdrawal from all the bundles on one side of the A-frame connected to one 1st-stage ejector and the noncondensible gas withdrawal from all the bundles on the other side of the A-frame connected to a second 1st-stage ejector, both ejectors serving only that one fan cell.

13. The bundles of claims 8 oriented such that the main steam supply header is at the apex of the A-frame with the steam flowing downward in the 1st-pass tubes.

14. The bundles of claims 8 oriented such that the main steam supply header is at the bottom of the A-frame with the steam flowing upward in the 1st-pass tubes.

15. A multiplicity of the claim 1 tube-set assembled to form a bundle whose thermal performance characteristics and whose mass of uncondensed steam flowing in the 1st-pass tubes are established by the number of 2nd-pass tube-sets that are incorporated into the bundle, with the number varying from one tube per bundle to half of the installed tubes in the bundle.

16. A steam condensing bundle comprising a plurality of air-cooled heat exchange tubes, each tube having an input end and an output end with a generally oblong shaped cross sectional configuration, means to support the tubes inclined in a parallel side by side array of tubes, the array of tubes of the bundle including a plurality of 2nd-pass tubes and a plurality of 1st-pass tubes with the 2-pass tubes located between the 1st-pass tubes to form symmetric sets of tubes each set having a central 2nd-pass tube and 1st-pass tube means on opposite sides thereof, the input ends of the 1st-pass tubes located to receive steam and noncondensible gases for partially condensing the received steam in the 1st-pass tubes, the input ends of the 2nd-pass tubes being located adjacent to the output ends of the 1st-pass tubes to symmetrically receive the partially condensed steam and noncondensible gases from the 1st-pass tubes for condensing the received remaining steam in the 2nd-pass tubes, each 2nd-pass tube having vacuum means associated with its output end to remove the noncondensible gases.

* * * * *